US006047692A

United States Patent [19]

Toyoda

[11] Patent Number: 6,047,692

[45] Date of Patent: Apr. 11, 2000

[54] ABNORMALITY-DIAGNOSING DEVICE FOR EVAPORATION PURGE SYSTEM AND AIR-FUEL RATIO CONTROLLER FOR INTERNAL COMBUSTION ENGINE HAVING THE ABNORMALITY-DIAGNOSING DEVICE INCORPORATED THEREIN

[75] Inventor: Katsuhiko Toyoda, Shizuoka-ken, Japan

[73] Assignee: Suzuki Motor Corporation, Shizuoka-ken, Japan

[21] Appl. No.: 09/109,360

[22] Filed: Jul. 2, 1998

[30] Foreign Application Priority Data

Jul. 4, 1997 [JP] Japan ..... 9-194782

[51] Int. Cl.[7] ..... F02D 41/00

[52] U.S. Cl. ..... 123/698; 123/516

[58] Field of Search ..... 123/516, 518, 123/520, 519, 521, 198 D, 690, 698; 73/118.1

[56] References Cited

U.S. PATENT DOCUMENTS

| | | | |
|---|---|---|---|
| 5,216,991 | 6/1993 | Iida et al. | 123/339 |
| 5,295,472 | 3/1994 | Otsuka et al. | 123/520 |
| 5,317,909 | 6/1994 | Yamada et al. | 73/118.1 |
| 5,425,344 | 6/1995 | Otsuka et al. | 123/520 |
| 5,460,143 | 10/1995 | Narita | 123/520 |
| 5,699,775 | 12/1997 | Azuma | 123/520 |
| 5,731,514 | 3/1998 | Miwa et al. | 73/118.1 |

FOREIGN PATENT DOCUMENTS

| | | |
|---|---|---|
| 4-136468 | 5/1992 | Japan . |
| 5-125997 | 5/1993 | Japan . |
| 5-180099 | 7/1993 | Japan . |
| 5-180100 | 7/1993 | Japan . |
| 5-180101 | 7/1993 | Japan . |
| 5-187332 | 7/1993 | Japan . |
| 5-223019 | 8/1993 | Japan . |

*Primary Examiner*—Henry C. Yuen
*Assistant Examiner*—Mahmoud M Gimie
*Attorney, Agent, or Firm*—Flynn, Thiel, Boutell & Tanis, P.C.

[57] ABSTRACT

An abnormality-diagnosing device for an evaporation purge system and an air-fuel ratio controller for an internal combustion engine having the abnormality-diagnosing device incorporated therein, which device can: prevent misdiagnosis as abnormal, which otherwise would occur under the influence of evaporative fuel caused by altitude, or change or swinging of fuel level or fuel; prevent deviation of an air-fuel ratio from a target value during purging of the evaporative fuel, which otherwise would occur under influence of the evaporative fuel resulting from altitude or fuel level; and, prevent deviation of the air-fuel ratio from the target value when the purge valve is opened, whereby a failure in drivability or aggravation of harmful exhaust component values can be prevented when the evaporative fuel is purged. The abnormality-diagnosing device includes a control device whereby, when a purge amount accumulation value exceeds an abnormality diagnosis start purge amount accumulation-determining value after start-up of the engine, then control is executed to diagnose at least one of an internal tank pressure sensor and an atmosphere valve as abnormal when an internal tank pressure does not reach any value between minimum and maximum internal tank pressure values with reference to atmospheric pressure in a state of the purge valve being closed and the atmosphere valve being opened.

12 Claims, 6 Drawing Sheets

ABNORMALITY-DIAGNOSING DEVICE FOR EVAPORATION PURGE SYSTEM AND AIR-FUEL RATIO CONTROLLER FOR INTERNAL COMBUSTION ENGINE HAVING THE ABNORMALITY-DIAGNOSING DEVICE INCORPORATED THEREIN

FIELD OF THE INVENTION

This invention relates to both an abnormality-diagnosing device for an evaporation purge system and an air-fuel ratio controller for an internal combustion engine having the abnormality-diagnosing device incorporated therein. More particularly, it relates to both an abnormality-diagnosing device for an evaporation purge system and an air-fuel ratio controller for an internal combustion engine having the abnormality-diagnosing device incorporated therein, whereby it is possible to prevent a misdiagnosis of abnormality due to the influence of evaporation fuel, which evaporative fuel is caused by the altitude and change in a fuel level and/or the sloshing of fuel, to prevent a deviation of an air-fuel ratio from a target value under the influence of the evaporative fuel resulting from the altitude or the fuel level when the evaporative fuel is purged, and to prevent a deviation of the air-fuel ratio from the target value when the purge valve is opened, whereby a failure in drivability and/or aggravation of harmful exhaust component values can be prevented when the evaporative fuel is purged.

BACKGROUND OF THE INVENTION

In some internal combustion engines disposed in vehicles and the like, there is provided an evaporation purge system in order to prevent evaporative fuel, which fuel is generated in a fuel tank, etc., from leaking into the ambient air from the fuel tank. In such an evaporation purge system, the evaporated fuel is introduced into a canister from the fuel tank through an evaporation passage. The canister contains an absorbent material such as activated carbon. Such introduced fuel is at first absorbed and retained in the canister, but is liberated and discharged from the canister when the engine is run, and is then purged into an intake passage through a purge passage for combustion in the engine.

In the evaporation purge system, when abnormalities such as faults or breakage occur in the canister, the passages, or valves, etc., then it follows that the evaporative fuel leaks into the atmosphere. In order to avoid this, some of the evaporation purge systems include an abnormality-diagnosing device. Examples of such abnormality-diagnosing devices are disclosed in published Laid-Open Japanese Patent Application Nos. 5-125997, 5-180099, 5-180100, 5-180101, 5-187332, 5-223019, and 4-136468.

In the abnormality-diagnosing device disclosed in No. 5-125997, when a vehicle stops, a purge control valve of a canister as well as a block valve for blocking an atmosphere aperture of the canister are completely closed during engine idle operation, thereby causing a space between a fuel tank and an intake passage to be enclosed in a gas tight condition under atmospheric pressure. In this state, the pressure is measured and how much the pressure varies is determined. Next, the purge control valve is fully opened to introduce negative intake pipe pressure, and then it is measured how much the pressure varies under such negative pressure, gas tight condition. When the latter pressure variation amount under the negative pressure is greater than the former pressure variation amount under the atmospheric pressure, then the abnormality-diagnosing device detects the presence of leakage.

In the abnormality-diagnosing device disclosed in No. 5-180099, a purge-side valve and a canister atmosphere aperture valve are both closed, and then the internal tank pressure achieves a predetermined pressure, whereby the pressure inside the system reaches a near-stable value. Such a pressure value and another value, which is measured after lapse of a predetermined period of time, are used to calculate a variation rate. When the variation rate is greater than a threshold value, it means that there is leakage in excess of a prescribed level of leakage. Then, the abnormality-diagnosing device judges the system as a failure, and turns on a warning lamp.

In the abnormality-diagnosing device disclosed in No. 5-180100, a variation rate is calculated on the basis of: respective internal tank pressures which are measured when the canister atmosphere aperture valve and the purge-side valve are each closed; and, another internal tank pressure after elapse of a given time period. The calculated variation rate is then compared in magnitude with a threshold value, thereby causing the device to diagnose possible system failures. Thereafter, the canister atmosphere aperture valve is opened, but the purge-side valve is prohibited from being opened in order to retain such an isolated state until the internal tank pressure achieves the atmospheric pressure or positive pressure. In this way, the evaporative fuel inside the canister is purged back into the fuel tank.

In the abnormality-diagnosing device disclosed in No. 5-180101, when the internal tank pressure achieves a value, which is greater toward negative pressure than a predetermined leakage determination-starting negative pressure, after the purge-side valve and the canister atmosphere aperture valve are both closed, then the purge-side valve is judged as a failure in valve opening. Then, the canister atmosphere aperture valve is opened, and the warning lamp is switched on. When the internal tank pressure does not achieve a predetermined value, even with lapse of a predetermine period of time, which predetermined value lies somewhat toward negative pressure with reference to the atmospheric pressure, then the canister atmosphere aperture valve is judged as a failure in valve closing, and the warning lamp is switched on.

In the abnormality-diagnosing device disclosed in No. 5-187332, an opening in a rotational speed control valve is adjusted so as to achieve a target revolving speed during engine idle operation, thereby controlling intake air quantity. An air-fuel ratio is controlled at a given level by means of an oxygen sensor. In such a situation, a purge control valve is forcedly switched into a completely closed state and a predetermined opening state, and then it is determined at this time how much the opening degree of the aforesaid rotational speed control valve is varied. When such a variation amount of the opening of the rotational speed control valve falls out of a predetermined permissive range, then the abnormality-diagnosing device determines the occurrence of abnormalities, and then warns the user thereof by turning on the warning lamp.

In the abnormality-diagnosing device disclosed in No. 5-223019, a variation in pressure inside the system for a predetermined period of time is calculated after the purge-side valve is opened, but the canister atmosphere aperture valve is closed. When such a variation rate is less than a predetermined value, it means the presence of a large leakage, thereby making a failure determination. When the variation rate is determined to be greater than the predetermined value, then the purge-side valve and the canister atmosphere aperture valve are both closed after an internal negative tank pressure reaches a predetermined value, whereby a failure diagnosis is made on the basis of how much the pressure inside the system is varied for a predetermined period of time.

In the abnormality-diagnosing device of No. 4-136468, an evaporative fuel processor includes means for absorbing fuel vapor in the fuel tank and a purge system for supplying the fuel vapor to an intake system of an engine. A failure diagnosis of the purge system is made on the basis of detected variations in an air-fuel ratio in the engine. The evaporative fuel processor comprises a failure-determining condition change means for changing a failure-determining condition, depending upon a rise in a fuel vapor pressure inside the fuel tank, so as to enhance the accuracy of failure determination. The aforesaid failure-determining condition is determined in accordance with operated states of both the purge system and the intake system.

In an abnormality-diagnosing device for diagnosing abnormalities in the evaporation purge system, an atmosphere valve for opening and closing the canister to/from the atmosphere is closed, while a purge valve is opened. In this way, negative intake pressure is established until internal tank pressure "PTNK" of the fuel tank reaches a target internal tank pressure "POTNK", as illustrated in FIG. 3. Then, the abnormality-diagnosing device diagnoses the evaporation purge system as abnormal when "PTNK" does not achieve "POTNK" after lapse of given time "t3" from the moment when the atmosphere valve is closed, but the purge valve is opened. In addition, when "PTNK" reaches "POTNK", then the abnormality-diagnosing device closes the purge valve, thereby causing the evaporation passage system to remain closed. Then, the abnormality-diagnosing device diagnoses the evaporation purge system as abnormal when internal tank pressure variation "DPTNK" is greater than internal tank pressure variation-determining value "PLEAK" after lapse of given time "t1" from the moment when the purge valve was closed.

However, there is a problem with the evaporation purge system which is designed to regulate a purge flow rate by the purge valve being driven based on a duty value. As illustrated in FIG. 4, the problem is that the purge flow rate decreases with a decrease in atmospheric pressure as the altitude rises from plains (i.e. low altitudes) to uplands (i.e. high altitudes), even with the duty value for the driving of the purge valve being invariable.

As a result, when the abnormality-diagnosing device executes an abnormality diagnosis at high altitudes, "PTNK" is slower in reaching "POTNK", even after the negative intake pressure is established by the atmosphere valve being closed, but the purge valve being opened; and, in some cases, "PTNK" does not reach "POTNK", even when given time "t3" has elapsed. This causes an inconvenience in that the abnormality-diagnosing device erroneously judges the evaporation purge system as abnormal.

In addition, since fuel in a fuel tank is more readily subject to vaporization with an increase in altitude, then given time "t3" is made longer. As a result, "PTNK" does note achieve "POTNK", even with lapse of time "t3". This causes another inconvenience in that the abnormality-diagnosing device misdiagnoses the evaporation purge system as abnormal.

Another inconvenience is that, when the evaporation purge system purges the evaporative fuel after "PTNK" achieved "POTNK" during idle operation and reduced load operation of the engine and, particularly, in a state in which the canister absorbs a large quantity of evaporative fuel, or in which the evaporative fuel readily occurs in the fuel tank because of an elevated altitude or temperature, then an air/fuel ratio is made richer, with a consequential failure in drivability or aggravation of harmful exhaust component values.

Further, there is a similar inconvenience when the purge valve is opened rapidly for purging of the evaporative fuel in a state in which the canister absorbs a large quantity of evaporative fuel, or when the evaporative fuel readily occurs in the fuel tank because of an elevated altitude or temperature, then the result is a richer air/fuel ratio with malfunctioned drivability and/or increased harmful exhaust component values.

SUMMARY OF THE INVENTION

To obviate or at least minimize the above inconveniences, the present invention provides an abnormality-diagnosing device for an evaporation purge system in an internal combustion engine. More specifically, the purge system includes an evaporation passage communicating with a fuel tank of the internal combustion engine, a canister receiving evaporative fuel from the fuel tank through the evaporation passage, a purge passage purging the evaporative fuel from the canister into an intake passage of the engine, an ambient air passage communicating the canister to the atmosphere, an internal tank pressure sensor for detecting an internal tank pressure of the fuel tank, a purge valve driven on the basis of a duty value for regulating a purge flow rate, and an atmosphere valve for opening and closing the canister to/from the atmosphere. The abnormality-diagnosing device includes a control means whereby, when a purge amount accumulation value according to the evaporation purge system exceeds an abnormality diagnosis start purge amount accumulation-determining value after engine start-up, the control is executed in such a manner as to diagnose at least one of the internal tank pressure sensor and the atmosphere valve as abnormal when the internal tank pressure detected by the internal tank pressure sensor does not reach any value between minimum and maximum internal tank pressure values with reference to atmospheric pressure in a state with the purge valve being closed and the atmosphere valve being opened.

The abnormality-diagnosing device is further characterized in that the control means provides control so as to correct the abnormality diagnosis start purge amount accumulation-determining value in accordance with an atmospheric pressure correction factor and a fuel level correction factor.

The present invention further provides an abnormality-diagnosing device for an evaporation purge system of an internal combustion engine, wherein the purge system includes an evaporation passage communicating with a fuel tank of the internal combustion engine, a canister receiving evaporative fuel from the fuel tank through the evaporation passage, a purge passage for purging the evaporative fuel from the canister into an intake passage of the engine, an ambient air passage communicating the canister to the atmosphere, an internal tank pressure sensor for detecting an internal tank pressure of the fuel tank, a purge valve driven based on a duty value for regulating a purge flow rate, and an atmosphere valve for opening and closing the canister to/from the atmosphere. The abnormality-diagnosing device includes a control means whereby, when a purge amount accumulation value exceeds an abnormality diagnosis start purge amount accumulation-determining value after engine start-up, both the internal tank pressure sensor and the atmosphere open valve are diagnosed as normal when the internal tank pressure achieves any value between minimum and maximum internal tank pressure values with reference to atmospheric pressure in a state wherein the purge valve is closed and the atmosphere open valve is opened, and wherein after the internal tank pressure detected by the internal tank pressure sensor achieves a target internal tank pressure through purging of the evaporative fuel by the atmosphere valve being closed and the purge valve being opened slowly, then control is executed in such a manner as to diagnose both of the evaporation passage and the purge passage as normal when the internal pressure tank is less than the target pressure, even with lapse of a given time in a state of the purge valve and the atmosphere valve both being closed.

The abnormality-diagnosing device is characterized in that, while the evaporative fuel is purged by the atmosphere valve being closed and the purge valve being opened slowly in accordance with the duty value, the control means practices control so as to retain the purge valve duty value at a given value when a fuel feedback correction amount achieves a correction limit value in air-fuel ratio control, and the control means executes control so as to reopen the purge valve slowly according to the duty value when the fuel feedback correction amount is returned from the correction limit value toward a non-limit by a predetermined value.

The abnormality-diagnosing device is further characterized in that the control means monitors at least one of a throttle opening variation amount and an engine load variation amount of the engine and a posture variation amount of a vehicle having the engine disposed therein during execution of an abnormality diagnosis, and that the control means provides control so as to stop the abnormality diagnosis when such a variation amount exceeds a diagnosis stop variation amount-determining value.

The abnormality-diagnosing device is still further characterized in that the control means monitors an abnormality diagnosis time fuel feedback correction amount during execution of an abnormality diagnosis, the abnormality diagnosis time fuel feedback correction amount being added in air-fuel ratio control, and the control means provides control so as to stop the abnormality diagnosis when the abnormality diagnosis time fuel feedback correction amount exceeds a diagnosis stop correction amount-determining value.

The abnormality-diagnosing device is also characterized in that the control means provides control so as to correct the given time according to an atmospheric pressure correction factor and a fuel level correction factor, in which given time, a determination and a comparison are made between an internal tank pressure and a target internal tank pressure in a state of the purge valve and the atmosphere valve both being closed.

Further, the present invention provides an air-fuel ratio controller for an internal combustion engine, the engine being equipped with an abnormality-diagnosing device for an evaporation purge system. The evaporation purge system includes an evaporation passage communicating with a fuel tank of the engine, a canister receiving evaporative fuel from the fuel tank through the evaporation passage, a purge passage purging the evaporative fuel from the canister into an intake passage of the engine, an ambient air passage communicating the canister to the atmosphere, an internal tank pressure sensor for detecting an internal tank pressure of the fuel tank, a purge valve controlled to open based on a duty value for regulating a purge amount, and an atmosphere open/close valve for opening and closing the canister to/from the atmosphere. The abnormality-diagnosing device diagnoses the evaporation purge system for abnormalities. The air-fuel ratio controller includes a control means whereby, during non-execution of the abnormal diagnosis by the abnormality-diagnosing device, a feedback control amount calculated from an output signal from an oxygen sensor, the oxygen sensor being disposed in an exhaust passage of the engine, is corrected in accordance with a fuel feedback correction amount, thereby executing air-fuel ratio control so as to bring an air-fuel ratio to a target value, and further learning control is executed so as to learn the fuel feedback correction amount, and wherein during execution of the abnormality diagnosis by the abnormality-diagnosing device, control is performed in such a manner to stop the learning control of the fuel feedback correction amount, and further the air-fuel ratio control is effected in such a manner to bring the air-fuel ratio to the target value by an abnormality diagnosis time fuel feedback correction amount being added to the fuel feedback correction amount.

The air-fuel ratio controller is characterized in that when the purge valve is opened during execution of the abnormality diagnosis by the abnormality-diagnosing device, then the control means provides correction control such that a proportional correction portion and an integral correction portion of the fuel feedback correction amount are made greater.

The abnormality-diagnosing device according to the present invention includes the control means whereby, when the purge amount accumulation value exceeds an abnormality diagnosis start purge amount accumulation-determine value after start-up of the engine, then control is executed in such a manner so as to diagnose at least one of the internal tank pressure sensor and the atmosphere open valve as abnormal when the internal tank pressure does not reach any value between minimum and maximum internal tank pressure values with reference to the atmospheric pressure in a state of the purge valve being closed and the atmosphere open valve being opened. As a result, the abnormality-diagnosing device can prevent a misdiagnosis as abnormal, even when a purge flow rate reduces with an increase in altitude from low to high. In this case, the control means provides control so as to correct the abnormality diagnosis start purge amount accumulation-determining value according to an atmospheric pressure correction factor and a fuel level correction factor. As a result, it can further ensure that the abnormality-diagnosing device prevents a misdiagnosis as abnormal because of an altitude change.

In addition, the abnormality-diagnosing device according to the present invention includes the control means whereby, both of the internal tank pressure sensor and the atmosphere valve are diagnosed as normal, and after the internal tank pressure achieves a target internal tank pressure through purging of the evaporative fuel by the atmosphere valve being closed and the purge valve being opened slowly, then control is executed in such a manner so as to diagnose both the evaporation passage and purge passage as normal when the internal tank pressure is less than the aforesaid target pressure, even with lapse of the given time in a state of the purge valve and the atmosphere valve both being closed. As a result, with the abnormality-diagnosing device it is possible to prevent a richer air-fuel ratio due to rapid opening of the purge valve, while preventing the misdiagnosis as abnormal when a reduced purge flow rate occurs with increased altitude from lowlands to highlands.

At this time, while the evaporation fuel is purge by the atmosphere valve being closed and the purge valve being opened slowly in accordance with the duty value, the control means effects control so as to hold the duty value of the purge valve at a given value when a fuel feedback correction amount achieves a correction limit value in air-fuel ratio control. In addition, the control means executes control so as to reopen the purge valve slowly according to the duty value when the fuel feedback correction amount is returned from the correction limit value toward a non-limit by a predetermined value. As a result, the abnormality-diagnosing device is capable of preventing a rapid change in the air-fuel ratio.

In addition, the control means monitors at least one of an engine throttle opening variation amount and an engine load variation amount and a posture variation amount of a vehicle having the engine disposed therein during execution of the abnormality diagnosis. Then, the control means provides control so as to stop the abnormality diagnosis when such a variation amount exceeds a diagnosis stop variation amount-determining value. Further, the control means monitors an abnormality diagnosis time fuel feedback correction amount during execution of the abnormality diagnosis, which feedback correction amount is added in air-fuel ratio control. Then, the control means provides control so as to stop the abnormality diagnosis when the abnormality diagnosis time fuel feedback correction amount exceeds the diagnosis stop correction amount-determining value. As a result, the abnormality-diagnosing device is capable of avoiding a misdiagnosis as abnormal, such as due to sloshing or splashing of fuel within the fuel tank.

Further, the control means provides control so as to correct the given time in accordance with the atmospheric pressure correction factor and the fuel level correction factor, in which given time, a determination and comparison are made between the internal tank pressure and the target internal tank pressure in a state of both the purge valve and the atmosphere valve being closed. Accordingly, the abnormality-diagnosing device is capable of making a determination in consideration of different states in which the evaporative fuel results from altitude and/or temperature.

Further, the air-fuel ratio controller according to the present invention includes the control means whereby, during non-execution of the abnormal diagnosis by the abnormality-diagnosing device, a feedback control amount calculated from an output signal of the oxygen sensor is corrected according to a fuel feedback correction amount, thereby executing air-fuel ratio control so as to bring an air-fuel ratio to a target value, and further learning control is executed so as to learn the fuel feedback correction amount. During execution of the abnormality diagnosis by the abnormality-diagnosing device, the control means performs control so as to stop the learning control of the fuel feedback correction amount, and further effects the air-fuel ratio control so as to bring the air-fuel ratio to the target value by the abnormality diagnosis time fuel feedback correction amount being added to the fuel feedback correction amount. As a result, the air-fuel ratio controller can be prevented from learning an unusual state of a fuel feedback correction amount when the abnormality-diagnosing device diagnoses the evaporation purge system for abnormalities.

In this case, when the purge valve is opened during execution of the abnormality diagnosis by the abnormality-diagnosing device, then the control means provides correction control such that a proportional correction portion and integral correction portion of the fuel feedback correction amount are made greater. As a result, variations of the air-fuel ratio caused by feedback control pursuit can be reduced.

Other objects and purposes of the invention will be apparent to persons familiar with systems of this general type upon reading the following specification and inspecting the accompanying drawings.

BRIEF DESCRIPTION OF THE DRAWINGS

An embodiment of the present invention will now be described with reference to the drawings wherein.

DETAILED DESCRIPTION

Figure 10:
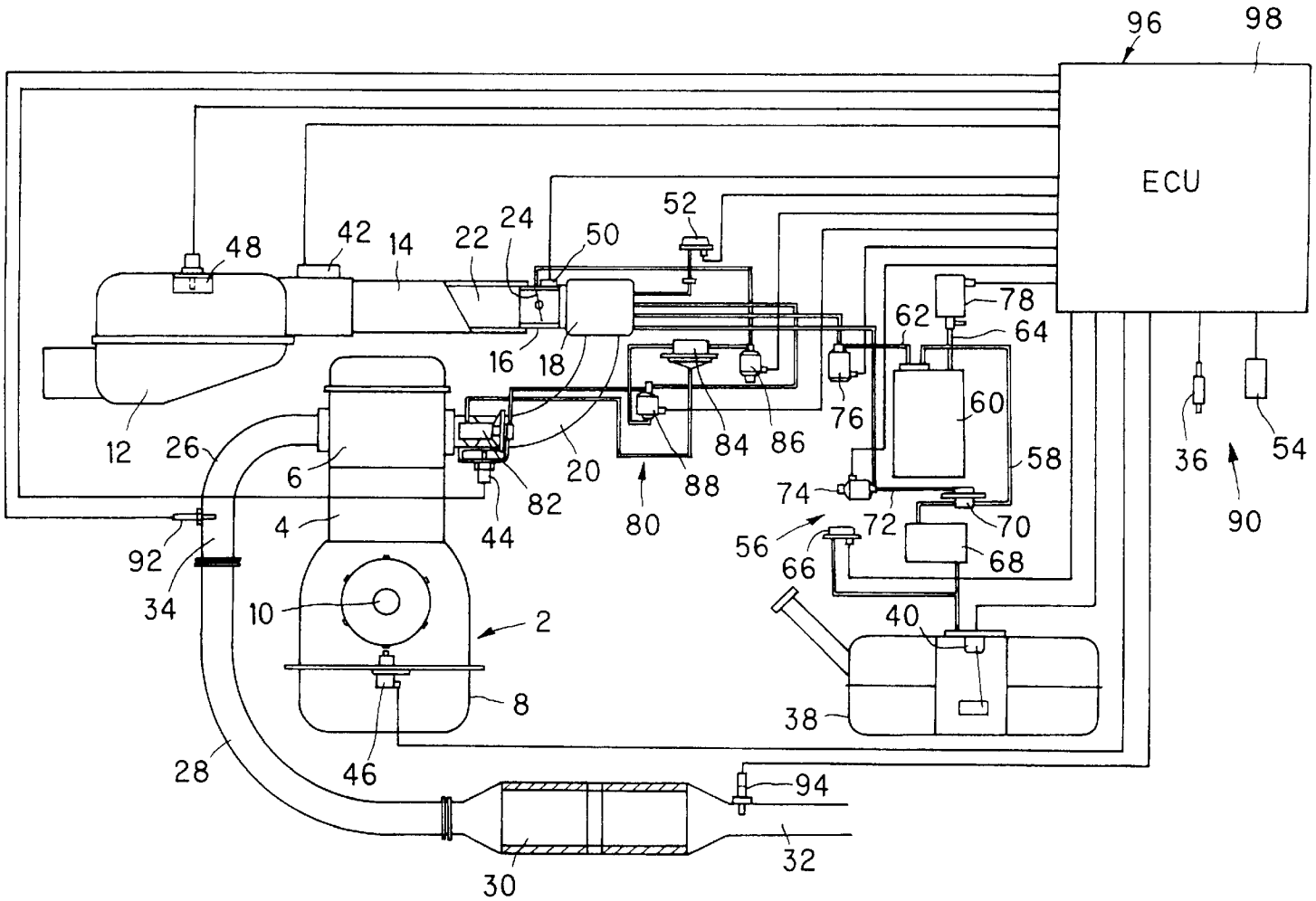
FIG. 10 is a systematic structure view showing the abnormality-diagnosing device and the air-fuel ratio controller.

In FIG. 10, reference numeral 2 denotes an internal combustion engine disposed in a vehicle (not shown); 4 denotes a cylinder block; 6 denotes a cylinder head; 8 denotes an oil pan; and 10 denotes a crankshaft.

The engine 2 has an intake system which includes an air cleaner 12, an intake pipe 14, a throttle body 16, a surge tank 18, and an intake manifold 20. The intake pipe 14 defines therein an intake passage 22. The throttle body 16 includes a throttle valve 24. The engine 2 also has an exhaust system which includes an exhaust manifold 26, an exhaust pipe 28, a catalytic converter 30, and a rear exhaust pipe 32. The exhaust manifold 26 defines therein an exhaust passage 34.

The engine 2 has a fuel injection valve 36 as part of a fuel supply means. The valve 36 is an injector and supplier of fuel fed from a fuel tank 38 which has a level gauge 40 positioned therein for detecting fuel level.

The engine 2 is further provided with: an air flow meter 42 for detecting an intake air flow rate; a water temperature sensor 44 for detecting the temperature engine coolant; a crankshaft angle sensor 46 for detecting the rotational angle of the crankshaft 10; an intake temperature sensor 48 for detecting intake air temperature; a throttle opening sensor 50 for detecting an opening degree of the throttle valve 24; an intake pressure sensor 52 for detecting the inlet air pressure; and an atmospheric pressure sensor 54.

The engine 2 incorporates an evaporation purge system 56 therein. The system 56 includes an evaporation passage 58 and a canister 60. The evaporation passage 58 communicates with the fuel tank 38, and evaporative fuel is introduced into the canister 60 through the evaporation passage 58. The introduced fuel is then absorbed and retained in the canister 60 by an absorbent material. Such absorbingly retained fuel is then released and discharged from the canister 60. The canister 60 is connected to a purge passage 62 and an ambient air passage 64. The evaporative fuel is purged into the intake passage 22 through the purge passage 62. The ambient air passage 64 opens to the atmosphere.

The evaporation passage 58 is provided with: an internal tank pressure sensor 66 for detecting internal fuel tank pressure; a separator 68 for separating the fuel into gas and liquid; and a pressure control valve 70 for regulating the pressure of the fuel tank 38. The pressure control valve 70 communicates with the surge tank 18 through a pressure passage 72. The pressure passage 72 is equipped with a negative pressure control valve 74.

The purge passage 62 includes a purge valve 76. The purge valve 76 is driven based on a duty value so as to regulate a purge flow rate. The aforesaid ambient air passage 64 is provided with an atmosphere valve 78 for opening and closing the canister 60 respectively to and from the atmosphere.

The engine 2 is provided with an exhaust gas re-circulation controller 80 for re-circulating a portion of the exhaust air to the gas intake system. The re-circulating controller 80 includes an EGR valve 82 for regulating an EGR quantity. The EGR valve 82 is positioned in an EGR passage (not shown), which passage communicates the exhaust system and the intake system with one another.

The re-circulating controller 80 further includes a back pressure control valve 84, an EGR control valve 86, and an EGR determination valve 88. The controller 80 causes a hereinafter mentioned control means 98 to provide control over these valves 84, 86, and 88, thereby controlling pressure that is applied on the EGR valve 82. Further, the control means 98 actuates and controls the EGR valve 82 so as to regulate the EGR amount.

The engine 2 is further provided with an air-fuel ratio controller 90. By way of an exhaust sensor, the controller 90 has an oxygen sensor disposed in the exhaust passage 34. In the present embodiment, a front oxygen sensor 92 is disposed in the exhaust manifold 26, while a rear oxygen sensor 94 is positioned in the rear exhaust pipe 32.

The air-fuel ratio controller 90 causes the control means 98 to correct a feedback control quantity based on a fuel feedback correction quantity. The feedback control quantity is calculated from an output signal from the oxygen sensor 92. Then, the control means 98 operates the fuel injection valve 36, thereby providing control over the air/fuel ratio so as to cause the air/fuel ratio to be consistent with a target value. In addition, the control means 98 provides learning control means for learning the fuel feedback correction quantity, i.e. software programming in an IC.

Yet further, the engine 2 is provided with an abnormality-diagnosing device 96 for the evaporation purge system 56. The diagnosing device 96 is provided with the control means 98 and may be a suitable electronic circuit, i.e. an IC. The control means 98 has the following connected thereto and communicating therewith: the fuel injection valve 36; the level gauge 40; the air flow meter 42; the water temperature sensor 44; the crank angle sensor 46; the intake temperature sensor 48; the throttle opening sensor 50; the intake pressure sensor 52; the atmospheric pressure sensor 54; the internal tank pressure sensor 66; the negative pressure control valve 74; the purge valve 76; the atmosphere valve 78; the EGr control valve 86; the EGR determination valve 88; the front oxygen sensor 92; and the rear oxygen sensor 94.

When a purge quantity accumulation value according to the evaporation purge system 56 exceeds an abnormality diagnosis start purge quantity accumulation-determined value after start-up of the engine 2, then the abnormality-diagnosing device 96 causes the control means 98 to execute control so as to diagnose at least one of the internal tank pressure 66 and the atmosphere valve 78 as abnormal when the internal tank pressure does not reach any value between predetermined minimum and maximum internal fuel tank pressure values dependent on atmospheric pressure in a state with the purge valve 76 being closed and the atmosphere valve 78 being opened. The aforesaid internal fuel tank pressure is detected by the internal tank pressure sensor 66.

At this time, the abnormality-diagnosing device 96 causes the control means 98 to execute control so as to correct the abnormality diagnosis start purge quantity accumulation-determination value according to an atmospheric pressure correction factor and a fuel level correction factor.

Both of the internal tank pressure sensor 66 and the atmosphere valve 78 are at first diagnosed as normal; and after the internal tank pressure achieves a target internal tank pressure through purging of the evaporative fuel by the atmosphere valve 78 being closed and the purge valve 76 being opened slowly, then the device 96 causes the control means 98 to execute control so as to diagnose both the evaporation passage 58 and purge passage 62 as normal when the internal tank pressure is lower than the target internal tank pressure, even with lapse of a given time in a state with both the purge valve 76 and the atmosphere valve 78 being closed.

At this time, while the evaporated fuel is purged by the atmosphere valve 78 being closed and the purge valve 76 being opened slowly according to the duty value, then the device 96 causes the control means 98 to provide control so as to retain a duty value of the purge valve 76 at a given value when the fuel feedback correction quantity in the air-fuel ratio control reaches a correction limit value. In addition, when the fuel feedback correction quantity is returned from the correction limit value toward a reference value by a predetermined value, then the device 96 causes the control means 98 to execute control so as to reopen the purge valve 76 slowly according to the duty value.

Further, the device 96 causes the control means 98 to monitor at least one of a throttle opening variation amount and an engine load variation amount of the engine 2 and a posture (i.e. the side-to-side roll and/or the front-to-back inclination) variation amount of a vehicle having the engine 2 disposed therein during execution of an abnormality diagnosis. Then, the control means 98 effects control so as to stop the abnormality diagnosis when such a variation amount exceeds a diagnosis stop variation amount-determining value. In addition, the device 96 causes the control means 98 to monitor an abnormality diagnosis time fuel feedback correction amount during execution of the abnormality diagnosis, which correction amount is added in the air-fuel ratio control. Then, the control means 98 effects control so as to stop the abnormality diagnosis when the abnormality diagnosis time fuel feedback correction amount exceeds a diagnosis stop correction amount-determining value.

Yet further, the device 96 causes the control means 98 to provide control so as to correct the given time in accordance with an atmospheric pressure correction factor and a fuel level correction factor, in which given time, a determination and comparison are made to the internal tank pressure and the target internal tank pressure in a state with both the purge valve 76 and atmosphere valve 78 being closed.

Next, the operation of the abnormality-diagnosing device 96 will be described.

The abnormality-diagnosing device 96 detects leakage of evaporative fuel, and then diagnoses the evaporation purge system 56 as abnormal and the user is notified. Such leakage is caused by: faults in components such as the canister 60, the internal tank pressure sensor 66, the purge valve 76, and the atmosphere valve 78; and, disconnection, breakage and the like, such as in the evaporation passage 58, the purge passage 62, and the ambient air passage 64.

The engine 2 has a problem in that when the purge valve 76 is opened during execution of the abnormality diagnosis by the abnormality-diagnosing device 96 in a state where the evaporation fuel is present in large amounts inside the fuel tank 38 and the canister 60, then the air/fuel ratio is made richer, with a concomitant failure in drivability and aggravation of harmful exhaust component values. To avoid this problem, the evaporation purge system 56 carries out purging for a certain period of time after start-up of the engine 2 before the abnormality-diagnosing device 96 executes the abnormality diagnosis. The purge system 56 provides such purging with the atmosphere valve 78 being opened, and the purge valve 76 being driven based on the basis duty value "Pduty" to regulate the purge flow rate.

Figure 1:
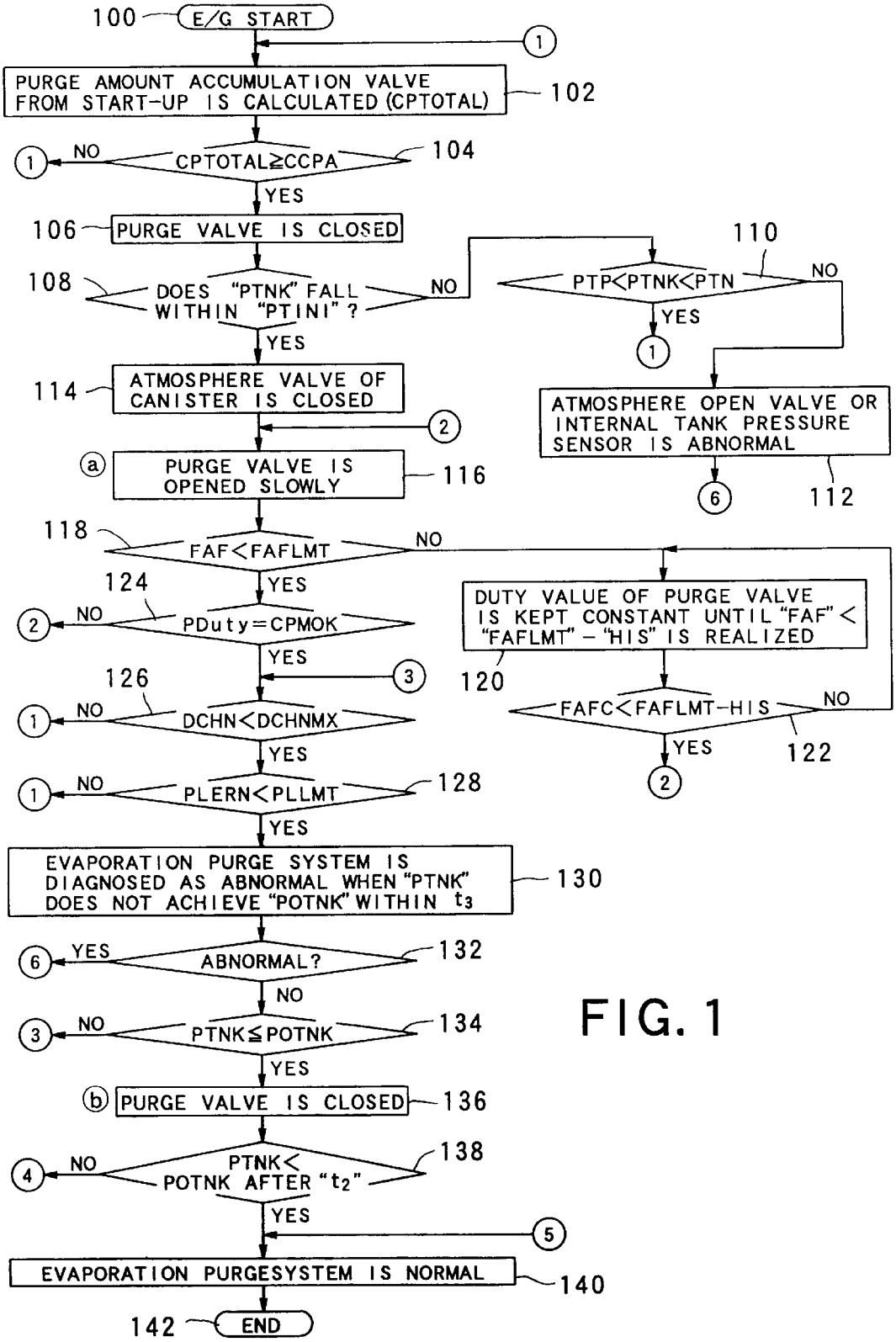
FIG. 1 is a flow chart illustrating a routine of control of an abnormality-diagnosing device according to an embodiment of the present invention.
Figure 5:
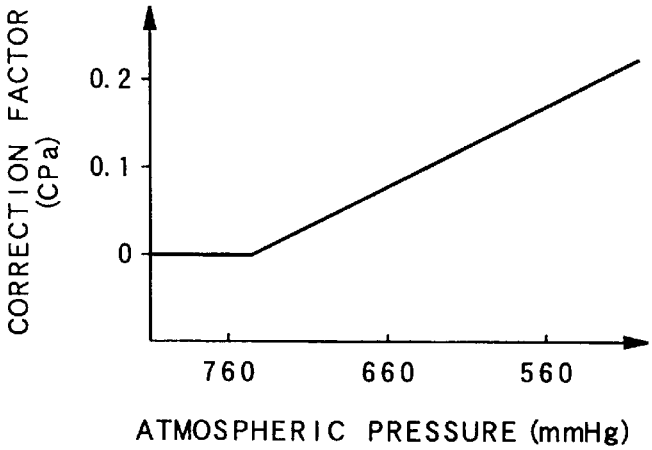
FIG. 5 is an illustration showing a correction factor with reference to the atmospheric pressure.
Figure 6:
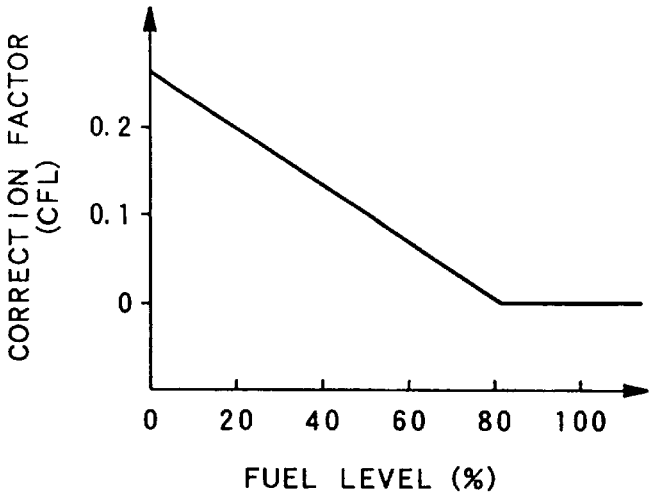
FIG. 6 is an illustration showing another correction factor with reference to the fuel level.

Referring now to FIG. 1, when control starts with start-up of the internal combustion engine 2 (step 100), then the abnormality-diagnosing device 96 calculates purge amount accumulation value "CPTOTAL" of evaporative fuel which has been purged for a period of time from the start-up of the engine 2 up to the present moment (step 102). Then, a determination is made as to whether "CPTOTAL" is greater than the abnormality diagnosis start purge amount accumulation-determining value "CCPA" (step 104). Since the evaporative fuel occurs in greater amounts at higher altitudes or with lower fuel levels "FLVL" of the fuel tank 38, and thus exercises a greater influence on drivability and harmful exhaust component values, then "CCPA" is established by abnormality diagnosis start purge amount accumulation-determining value "CPA" being corrected based on atmospheric pressure correction factor "CPa" and fuel level correction factor "CFL" according to the formula: $CCPA=CPA\times\{1+(CPa+CFL)\}$. FIGS. 5 and 6 illustrate correction factors CPa and CFL.

In the above determination (step 104), corrected value "CCPA" is compared with "CPTOTAL" for judgement.

When the above determination (step 104) results in "NO" because "CPTOTAL" is less than "CCPA", then the routine is returned to the previous stage (step 102).

When the determination (step 104) results in "YES", then the purge valve 76 is closed (step 106) to bring internal tank pressure "PTNK" back to the same level as the atmospheric pressure. Next, a determination is made as to whether "PTNK" falls within internal tank pressure determination range "PTINI" (step 108). At this time, the atmosphere valve 78 remains opened.

When the above determination (step 108) results in "NO" because "PTNK" lies outside "PTINI", then a determination is made as to whether "PTNK" achieves any value between maximum internal tank pressure value "PTP" and minimum internal tank pressure value "PTN" which are determined by the atmospheric pressure (step 110).

When the determination (step 110) results in "YES" because "PTNK" likes between "PTP" and "PTN", then the routine is returned to the previous stage (step 102).

Figure 2:
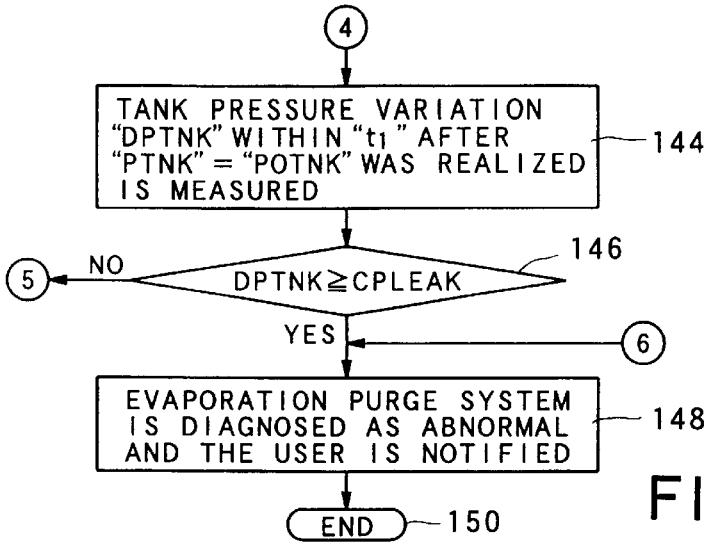
FIG. 2 is a flow chart showing another routine of control of the abnormality-diagnosing device in addition to FIG. 1.

When the determination (step 110) results in "NO", then at least one of the internal tank pressure sensor 66 and the atmosphere valve 78 is diagnosed as abnormal (step 112). Then, as illustrated in FIG. 2, the user is notified thereof, such as by a lamp (not shown) being switched on (step 148). Then, the routine is terminated (step 150).

When the previous determination (step 108) results in "YES" because "PTNK" lies within "PTINI", this means that the internal tank pressure sensor 66 and the atmosphere valve 78 are both normal. Then, the atmosphere valve 78 is closed (step 114). Next, the purge valve 76 is driven in accordance with duty value "Pduty", and is then opened slowly (step 116), thereby establishing negative intake pressure until internal intake pressure "PTNK" reaches target internal tank pressure "POTNK".

Figure 7:
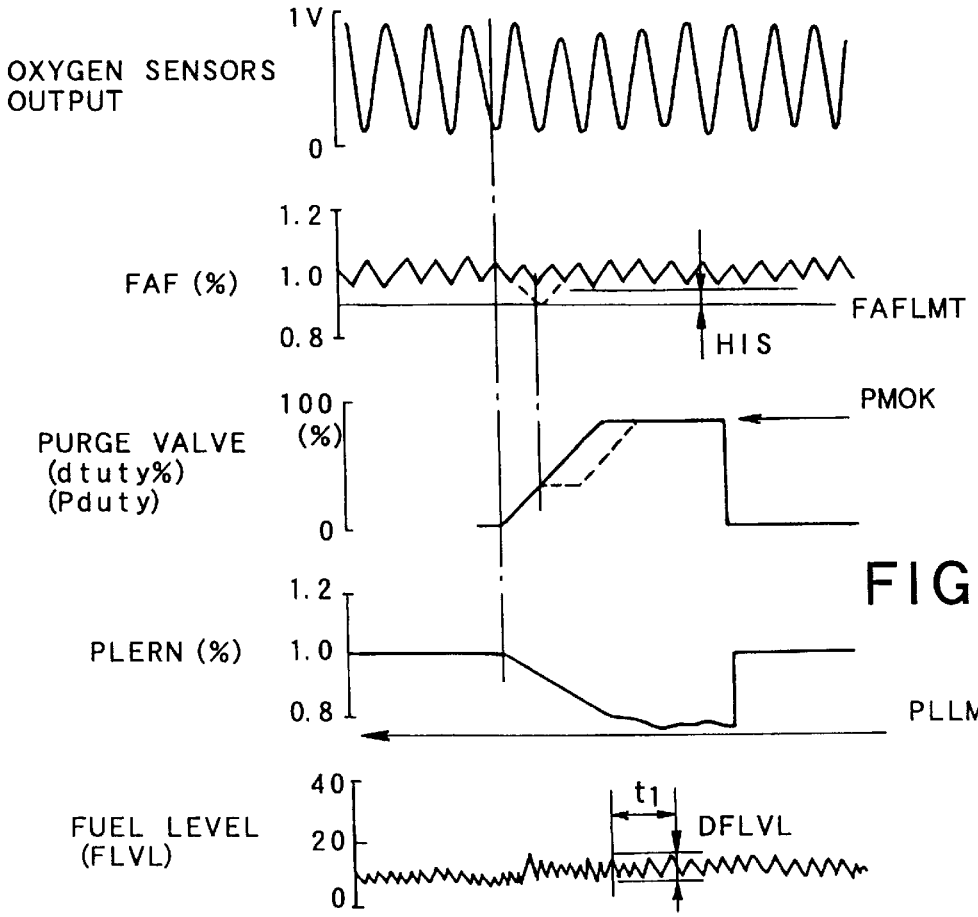
FIG. 7 is a timing chart descriptive of a stop of the abnormality diagnosis.

At this time, since rapid opening of the purge valve 76 causes engine troubles, i.e. malfunctioned drivability and/or aggravated harmful exhaust component values, then the purge valve 76 is opened slowly by "Pduty" being varied so that the purge valve opening is smoothly increased, as illustrated in FIG. 7.

Then, a determination is made as to whether purging through the smooth opening of the purge valve 76 (step 116) causes fuel feedback correction amount "FAF" to be less than correction limit value "FAFLMT" in the air-fuel ratio control by the air-fuel ratio controller 90, as illustrated in FIG. 7 (step 118).

When the determination (step 118) results in "NO" because "FAF" does not fall below "FAFLMT" as shown by the broken line in FIG. 7, but reaches "FAFLMT" ($FAF\geqq FAFLMT$), then "Pduty" is not allowed to be varied, but is kept constant until "FAF" is increased from "FAFLMT" at least by predetermined value "HIS" (step 120).

A determination is made as to whether "FAF" has been returned from "FAFLMT" by "HIS" with the state of "Pduty" being held constant (step 120), i.e. whether the equation $FAF<FAFLMT-HIS$ (step 122) is met.

When the determination (step 122) is "NO" because "FAF" has not been returned from "FAFLMT" toward the reference value by "HIS", then the routine is returned to the previous stage (step 120).

When the above determination (step 122) result in "YES", then the routine is stepped back to the previous stage (step 116) where the purge valve 76 is reopened slowly.

When the previous determination (step 118) results in "YES" because "FAF" is less than "FAFLMT" ($FAF<FAFLMT$) as seen from the broken line in FIG. 7, then a determination is made as to whether duty value "Pduty" of the purge valve 76 is equal to target duty value "CPMOK" (step 124).

The target duty value "CPMOK" is established by being corrected on the basis of an initial target duty value "PMOK", atmospheric pressure correction factor "CPa", and fuel level correction factor "CFL" by the equation: $CPMOK=PMOK\times\{1+(CPa+CFL)\}$.

When the determination (step 124) is "NO" because "Pduty" is unequal to "CPMOK", then the routine is returned to the previous stage (step 116) to open the purge valve 76 slowly.

When the determination (step 124) results in "YES", then a determination is made as to whether an abnormality diagnosis is stopped (step 126).

As illustrated in FIG. 7, when load variations of the engine 2, vehicle accelerations, and the like cause fuel in the fuel tank 38 to swing or slosh during execution of the abnormality diagnosis to the degree that fuel level variation "DFLVL" varies beyond fuel level variation-determining value "DFLMX", then fuel vapor easily occurs more frequently. As a result, "PTNK" does not reach "POTNK", whereby a misdiagnosis of abnormal may be made. Thus, the objective of the above determination (step 126) is to avoid such a misdiagnosis. Diagnosis is stopped when fuel swings for a period of "t1" at a degree greater than a fuel level variation-determining value "DFLMX".

In the determination (step 126), the swinging of the fuel in tank 38 is determined by variation amount "DCHN", which is one of a throttle opening variation amount of the throttle valve 24, an engine load variation amount of the engine 2, and a posture variation amount of a vehicle (not shown) having the engine 2 disposed therein. Then, a determination is made as to whether "DCHN" is less than diagnosis stop variation amount-determining value "DCHNMX". The determination (126) to stop the abnormality diagnosis is executed throughout all periods of time during execution of the abnormality diagnosis.

When the determination (step 126) results in "NO" because "DCHN" is greater than "DCHNMX", then the abnormality diagnosis is stopped and the routine is returned to the previous stage (step 102).

When the same determination (step 126) results in "YES", then another determination is made as to whether the abnormality diagnosis is stopped (step 128).

Figure 3:
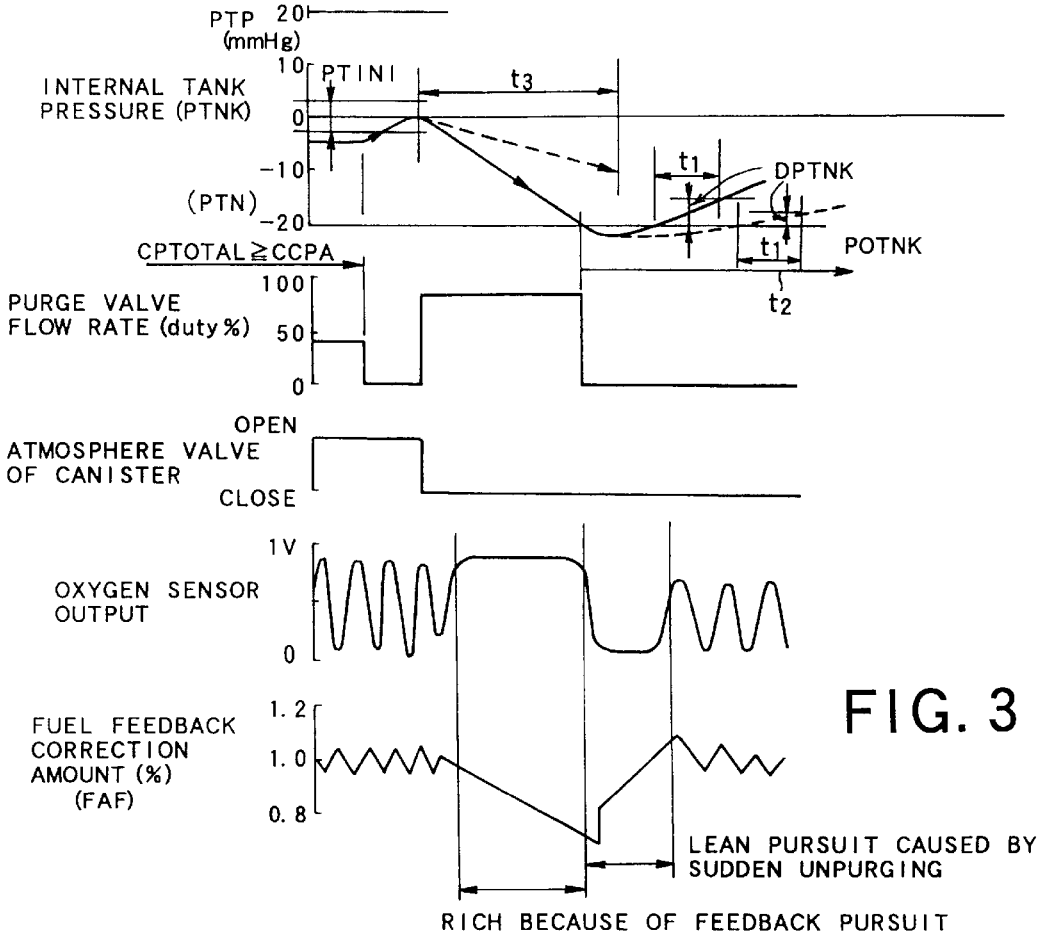
FIG. 3 is a timing chart descriptive of an abnormality diagnosis.
Figure 4:
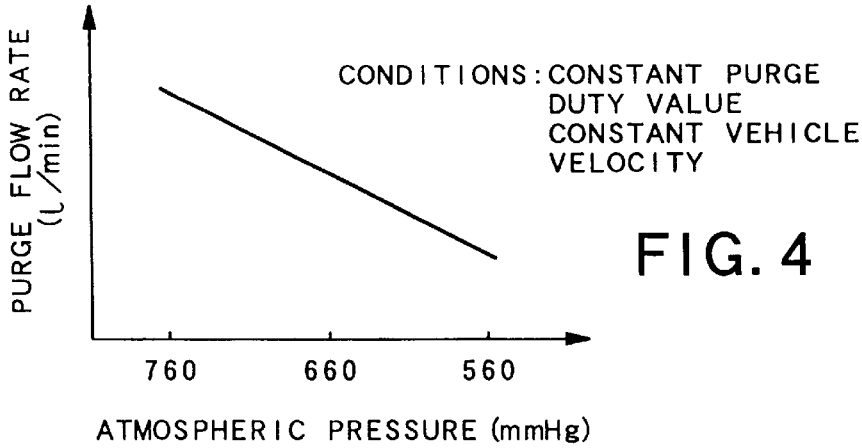
FIG. 4 is an illustration showing how a purge flow rate is varied with reference to the atmospheric pressure.

In the period of time designated by given second time "t2" in FIG. 3, since fuel vapor occurs more frequently with a greater variation in fuel feedback correction amount "FAF", then the fuel tank pressure "PTNK" does not reach the target fuel tank pressure "POTNK". This causes a misdiagnosis as abnormal. Therefore, the object of the above determination (step 128) is to avoid such a misdiagnosis.

In this determination (128), a determination is made as to whether abnormality diagnosis time fuel feedback correction amount "PLERN", which is added to the fuel feedback correction amount "FAF" in the air-fuel ratio control during execution of the abnormality diagnosis, is less than a diagnosis step correction amount-determining value "PLLMT".

When the determination (128) results in "NO" because "PLERN" is greater than "PLLMT", then the abnormality diagnosis is ceased and the routine returns to the previous stage (step 102).

When the same determination (128) results in "YES", then purging is continued until "PTNK" reaches "POTNK", as illustrated in FIG. 3. When "PTNK" does not achieve "POTNK" within given third time "t3", then a process for diagnosing the evaporation purge system as abnormal is carried out (step 130). A determination is made as to whether it is abnormal (step 132).

When the determination (step 132) is "YES" because of a judgement as abnormal, then the user is notified thereof, such as by the lamp (not shown) being turned on, as illustrated in FIG. 2 (step 148). Then, the routine is terminated (step 150).

When the same determination (step 132) results in "NO", then a determination is made as to whether "PTNK" has been less than or equal to "POTNK" (step 134).

When the determination (step 134) results in "NO" because "PTNK" has not reached "POTNK", then the routine is returned to step 126.

When the same determination (step 134) is "YES" because "PTNK" is less than "POTNK", then the purge valve 76 is closed (step 136). At this time, the atmosphere valve 78 has been closed by the process of the previous stage (i.e., step 114).

Time measurement is initiated from the moment when the purge valve 76 was closed (step 136). Then, a determination is made as to whether "PTNK" is less than "POTNK" when given second time "t2" has elapsed (step 138).

In given second time "t2", a determination and a comparison are made between internal tank pressure "PTNK" and target internal tank pressure "POTNK" in a state of the purge valve 76 and the atmosphere valve 78 being both closed. In view of the fact that the evaporated fuel occurs at different rates and amounts depending upon the atmospheric pressure and the fuel level, then given second time "t2" is established by being corrected on the basis of atmospheric pressure correction factor "CPa" and fuel level correction factor "CFL" by the equation: $T2=t2'\times\{1-(CPa+CFL)\}$.

When the determination (step 138) results in "YES" because "PTNK" is less than "POTNK" when the corrected given second time "t2" has elapsed, then the evaporation passage 58 and the bypassing purge passage 62 are both diagnosed as normal (step 140). Then, the routine is terminated (step 142).

When the same determination (step 138) results in "NO", then time measurement is made as to how long internal tank pressure variation "DPTNK" within given first time "t1" takes from the moment when "PTNK" becomes equal to "POTNK" again, as illustrated in FIG. 2 (step 144). Then, a determination is made as to whether "DPTNK" is greater than internal tank pressure variation abnormality-determining value "CPLEAK" (step 146).

When the determination (step 146) results in "NO" because "DPTNK" is less than "CPLEAK", then the evaporation passage 58 and the bypassing purge passage 62 are both diagnosed as normal (step 140). Then, the routine is terminated (step 142).

When the same determination (step 146) results in "YES", then at least one of the evaporation passage 58 and the bypassing purge passage 62 is diagnosed as abnormal, of which the user is notified, such as by the lamp (not shown) being switched on (step 148). Then, the routine is terminated (step 150).

Although internal tank pressure variation "DPTNK" is greater in the presence of leakage, evaporated fuel occurs at different rates and amounts, depending on the fuel level or the atmospheric pressure. Thus, the corrected internal tank pressure variation abnormality-determining value "CPLEAK" is established by correcting the internal tank pressure variation abnormality-determining value "PLEAK" according to atmospheric pressure correction factor "CPa", fuel level correction factor "CFL", abnormality diagnosis time fuel feedback correction amount "PLERN", and abnormality diagnosis time correction factor a in the equation: $CPLEAK=PLEAK\times\{1+(CPa+CFL)\}\times PLERN\times\alpha$. The abnormality diagnosis time correction factor a being approximately 0.5.

Thus, when purge amount accumulation value "CPTOTAL" exceeds abnormality diagnosis start purge amount accumulation-determining value "CCPA" after engine start-up, then the abnormality-diagnosing device 96 for the evaporation purge system 56 causes the control means 98 to control diagnosis of at least one of the internal tank pressure sensor 66 and the atmosphere open valve 78 as abnormal when internal tank pressure "PTNK" does not reach any value between maximum internal tank pressure value "PTP" and minimum internal tank pressure value "PTN" with reference to the atmospheric pressure in a state of the purge valve 76 being closed and the atmosphere valve 78 being opened (FIG. 3). As a result, the abnormality-diagnosing device 96 can prevent a misdiagnosis as abnormal, even when a purge flow rate reduces due to an increase in altitude from low to high.

In this case, the control means 98 effects a control operation to correct "CCPA" according to atmospheric pressure correction factor "CPa" and fuel level correction factor "CFL". As a result, it can further ensure that the abnormality-diagnosing device 96 prevents the misdiagnosis as abnormal due to a change in altitude.

In addition, both the internal tank pressure sensor 66 and the atmosphere valve 78 are at first diagnosed as normal; and, after internal tank pressure "PTNK" achieves a target internal tank pressure "POTNK" through purging of the evaporative fuel by the atmosphere valve 78 being closed and the purge valve 66 being opened slowly, then the control means 98 provides control so as to diagnose both the evaporation passage 58 and the purge passage 62 when "PTNK" is less than "POTNK", even with lapse of second given time "t2" in a state of the purge valve 76 and the atmosphere valve 78 both being closed. As a result, with the abnormality-diagnosing device 96 it is possible to prevent a richer air-fuel ratio due to rapid opening of the purge valve 76, while preventing the misdiagnosis as abnormal when a reduced purge flow rate occurs with an increase in altitude from low to high.

While the evaporative fuel is purged by the atmosphere valve 78 being closed and the purge valve 76 being opened slowly according to a duty value, the control means 98 practices control so as to retain the duty value of the purge valve 76 at a given value when fuel feedback correction amount "FAF" achieves correction limit value "FAFLMT" in the air-fuel ratio control. In addition, the control means 98 executes control so as to reopen the purge valve 76 slowly according to the duty value when "FAF" is returned from "FAFLMT" toward a non-limit by predetermined value "HIS". As a result, the abnormality-diagnosing device 96 can prevent a rapid change in the air-fuel ratio.

In addition, the control means 98 monitors at least one of a throttle opening variation amount and an engine load variation amount of the engine 2 and a posture variation amount of a vehicle having the engine positioned therein during the execution of the abnormality diagnosis. Then, the control means 98 provides control so as to stop the abnormality diagnosis when such a variation amount "DCHN" exceeds diagnosis stop variation amount-determining value "DCHNMX". Further, the control means 98 monitors abnormality diagnosis time fuel feedback correction amount "PLERN", which is added in the air-fuel ratio control, during the execution of the abnormality diagnosis, and then provides control so as to stop the abnormality diagnosis when "PLERN" exceeds diagnosis stop correction amount-determining value "PLLMT". As a result, with the abnormality-diagnosing device 96 it is possible to avoid the misdiagnosis as abnormal, such as due to the swinging or sloshing movement of fuel in the fuel tank.

Further, the control means 98 provides control so as to correct given second time "t2" according to "CPa" and "CFL", in which given second time "t2", a determination and a comparison are made between "PTNK" and "POTNK" in a state of the purge valve 76 and the atmosphere valve 78 both being closed. As a result, a determination can be made in consideration of different states in which the evaporative fuel results from the altitude or temperature.

As a result, the abnormality-diagnosing device 96 for the evaporation purge system 56 can prevent a misdiagnosis as abnormal during execution of the abnormality diagnosis, which misdiagnosis otherwise would occur under the influence of the evaporative fuel caused by the altitude, and the change and/or swinging movement of fuel level or fuel. In addition, the abnormality-diagnosing device 96 can prevent deviation of an air-fuel ratio from a target value during purging of the evaporative fuel, which otherwise would occur under the influence of the evaporative fuel resulting from the altitude or the fuel level.

The internal combustion engine 2, which is equipped with the abnormality-diagnosing device 96 for the evaporation purge system 56, is provided with the air-fuel ratio controller 90 as well.

During usual engine operation in which the abnormality-diagnosing device 96 conducts no abnormality diagnosis, the air-fuel ratio controller 90 corrects a feedback control amount according to the fuel feedback correction amount "FAF", and thereby provides air-fuel ratio control so as to bring the air-fuel ratio to a target value. The above feedback control amount is calculated from an output signal from the oxygen sensor 92. In addition, the air-fuel ratio controller 90 executes learning control such as to learn "FAF" for optimization.

In a state of the atmosphere valve 78 being closed and the purge valve 76 being opened through execution of the abnormality diagnosis by the abnormality-diagnosing device 96, the evaporative fuel from both the canister 60 and the fuel tank 38 is supplied directly to the engine 2. The air-fuel ratio is thereby rendered richer than in the usual state, resulting in malfunctioned drivability and aggravated harmful exhaust component values.

Thus, the air-fuel ratio controller 90 has a problem when learning and storing an unusual state of "FAF" when both performing the air-fuel ratio control according to normal fuel feedback correction amount "FAF" and the learning step for learning "FAF" during the execution of the abnormal diagnosis by the abnormality-diagnosing device 96.

Accordingly, the air-fuel ratio controller 90 causes the control means 98 to correct the feedback control amount on the basis of "FAF", thereby providing the air-fuel ratio control so as to force the air-fuel ratio into a target value during non-execution of the abnormality diagnosis by the abnormality-diagnosing device 96. The aforesaid feedback control amount is calculated from the output signal from the oxygen sensor 92 that is disposed on the exhaust passage 34 of the engine 2. In addition, the control means 98 provides the learning control so as to learn "FAF". Meanwhile, the air-fuel ratio controller 90 causes the control means 98 to perform control so as to stop the learning control of "FAF" during execution of the abnormality diagnosis by the abnormality-diagnosing device 96. In addition, the control means 98 executes the air-fuel ratio control so as to bring the air-fuel ratio to the target value by abnormality diagnosis time fuel feedback correction amount "PLERN" being added to fuel feedback correction amount "FAF".

Furthermore, when the purge valve 76 is opened during execution of the abnormality diagnosis by the device 96, then "FAF" is deviated by purging.

Figure 8:
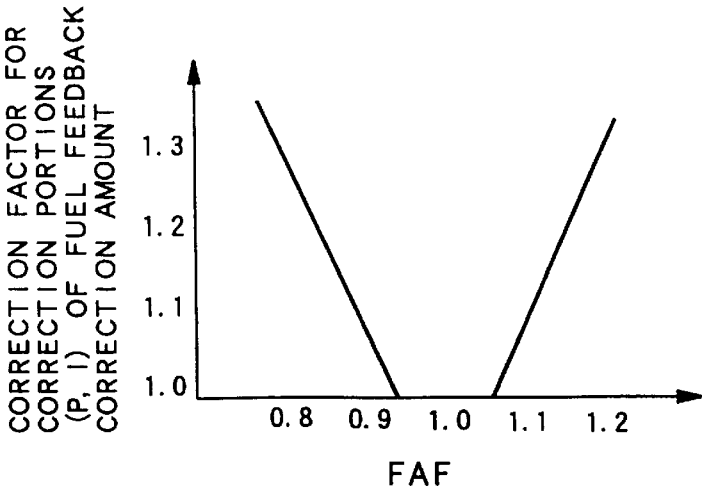
FIG. 8 is an illustration showing a correction factor of a fuel feedback correction amount.

In order to cope with this, when the purge valve 76 is opened during execution of the abnormality diagnosis by the device 96, then the controller 90 causes the control means 98 to provide correction control such that proportional correction portion "P" and integral correction portion "I" of "FAF" are made larger (FIG. 8).

Next, the operation of the air-fuel ratio controller 90 will be described.

Figure 9:
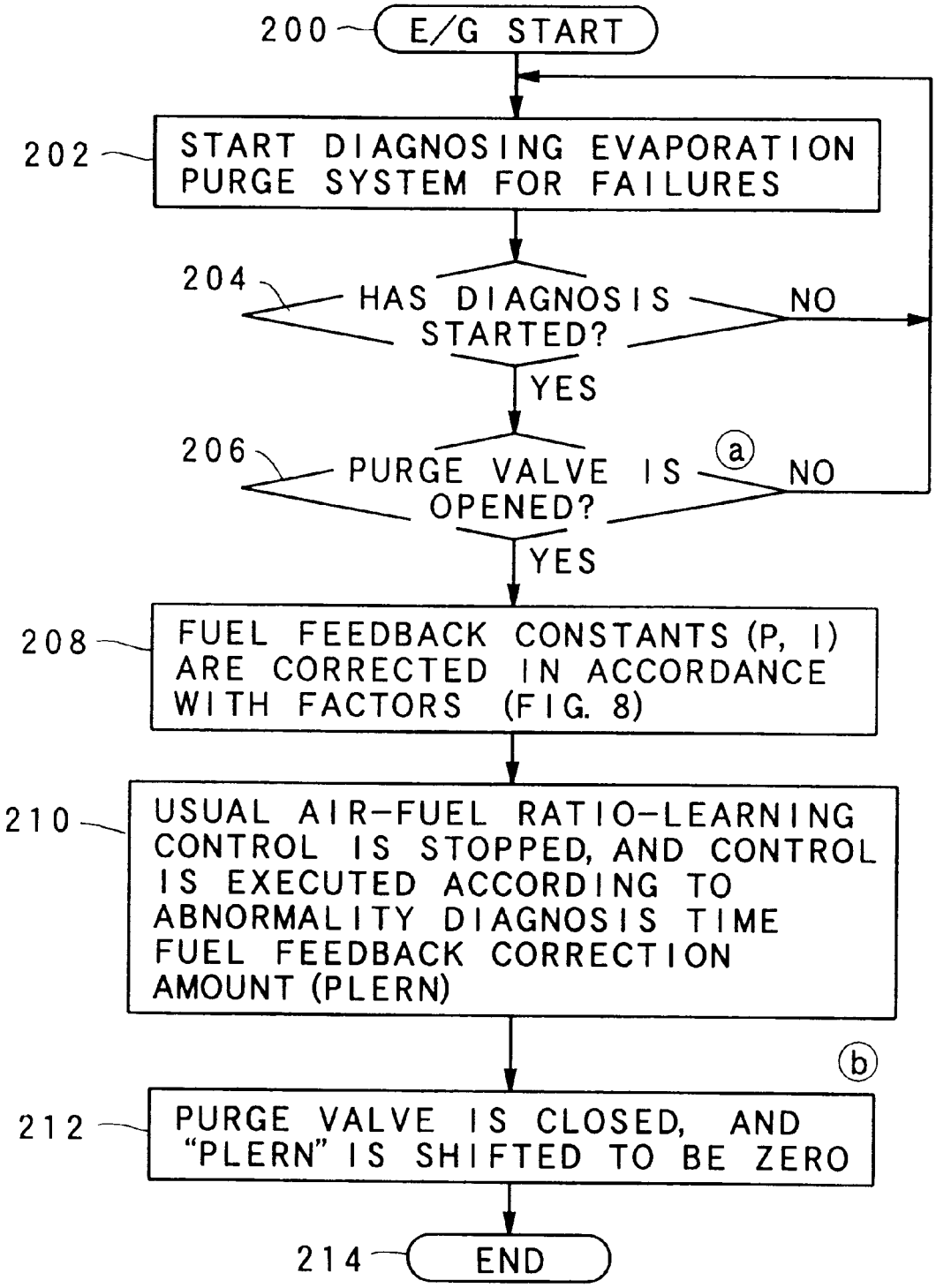
FIG. 9 is a flow chart, illustrating a routine of air-fuel ratio control of an air-fuel ratio controller.

As indicated in FIG. 9, the controller 90 initiates control in response to start-up of the engine 2 (step 200). Then, the controller 90 checks to see if the abnormality-diagnosing device 96 starts diagnosing the evaporation purge system 56 for abnormalities (step 202). Then, a determination is made as to whether the abnormality diagnosis is initiated (step 204).

When the determination (step 204) results in "NO" because no abnormality diagnosis has started, then the routine is returned to the previous stage (step 202). When the same determination (step 204) results in "YES", then a determination is made as to whether the purge valve 76 has been opened (step 206).

When the determination (step 206) results in "NO" because the purge valve 76 has not been opened, then the routine is returned to the previous stage (step 202). When the same determination (step 206) results in "YES", then a correction is made in accordance with the correction factor in such a manner that proportional correction portion "P" and integral correction portion "I" of fuel feedback correction amount "FAF" are made larger, as illustrated in FIG. 8 (step 208).

Next, the learning control of "FAF" is stopped, and then abnormality diagnosis time fuel feedback correction amount "PLEAN" is added to "FAF" in order to execute the air-fuel ratio control such that the air-fuel ratio reaches a target value (step 210), "PLEAN" is turned to be "0" (zero) when the purge valve 76 is closed (step 212). Then, the routine is terminated (step 214).

In this way, the air-fuel ratio controller 90 causes the control means 98 to correct the feedback control amount according to fuel feedback correction amount "FAF" during normal engine operation without the abnormal diagnosis being exercised by the abnormality-diagnosing device 96, whereby the air-fuel ratio control is executed in such a manner as to bring the air-fuel ratio to a target value. The aforesaid feedback control amount is calculated from the output signal from the oxygen sensor 92. In addition, the control means 98 executes the learning control so as to learn "FAF".

In addition, the air-fuel ratio controller 90 causes the control means 98 to execute control so as to stop the learning control of "FAF" during execution of the abnormality diagnosis by the device 96. The control means 98 further executes the air-fuel ratio control so as to force the air-fuel ratio into a target value by "PLERN" being added to "FAF".

As a result, the air-fuel ratio controller 90 can be prevented from learning an unusual state of "FAF" when the abnormality-diagnosing device 96 is diagnosing the evaporation purge system 56 to check for abnormalities.

In this case, when the purge valve 76 is opened during the execution of the abnormality diagnosis by the device 96, then correction control is executed in such a manner that proportional correction portion "P" and integral correction portion "I" of "FAF" are made greater. As a result, variations of the air-fuel ratio caused by feedback control pursuit can be reduced.

Consequently, with the air-fuel ratio controller 90 it is possible to prevent a deviation of the air-fuel ratio from a target value when the purge valve 76 of the evaporation purge system 56 is opened, and further to prevent a failure in drivability and/or aggravation of harmful exhaust component values when the evaporation purge system 56 purges the evaporative fuel.

As described above, the abnormality-diagnosing device for the evaporation purge valve according to the present invention is designed to prevent a misdiagnosis of abnormal, even when a purge flow rate reduces with an increase in vehicle altitude from low to high.

In addition, with the abnormality-diagnosing device it is possible to prevent a richer air-fuel ratio due to rapid opening of the purge valve, while preventing the misdiagnosis as abnormal when a reduced purge flow rate occurs with an increase in altitude from low to high. Further, the same device is capable of: preventing a rapid change in an air-fuel ratio; avoiding the misdiagnosis as abnormal, such as due to the sloshing of fuel; and, making a determination in consideration of different states in which evaporative fuel results due to changes in altitude or temperature.

As a result, when diagnosing the evaporation purge system to check for abnormalities, the abnormality-diagnosing device according to the present invention can prevent the misdiagnosis as abnormal, which otherwise would occur under the influence of the evaporative fuel caused by the altitude, or the change and/or swing of a fuel level or fuel. In addition, when the evaporation purge system purges the evaporative fuel, the abnormality-diagnosing device can prevent a deviation of the air-fuel ratio from a target value, which otherwise would occur under the influence of the evaporative fuel resulting from the altitude or the fuel level.

In addition, the air-fuel ratio controller for the internal combustion engine according to the present invention, which engine is equipped with the aforesaid abnormality-diagnosing device, can be prevented from learning an unusual state of a fuel feedback correction amount when the abnormality-diagnosing device diagnoses the evaporation purge system for abnormalities. As a result, variations of the air-fuel ratio caused by feedback control pursuit can be reduced.

Thus, the air-fuel ratio controller is adapted to prevent a deviation of the air-fuel ratio from a target value when the purge valve of the evaporation purge system is opened, and further to prevent a failure in drivability and/or aggravation of harmful exhaust component values when the evaporation purge system purges the evaporative fuel.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An abnormality-diagnosing device for an evaporation purge system of an internal combustion engine, said purge system including: an evaporation passage communicated to a fuel tank of said engine, a canister into which evaporative fuel is introduced from said fuel tank through said evaporation passage, a purge passage through which the evaporative fuel is purged from said canister into an intake passage of said engine, an ambient air passage through which said canister communicates to the atmosphere, an internal tank pressure sensor for detecting internal tank pressure of said fuel tank, a purge valve driven on the basis of a duty value for regulating a purge flow rate, and an atmosphere valve for opening and closing said canister to/from the atmosphere; said abnormality-diagnosing device comprising: a control means providing control so as to correct the abnormality diagnosis start purge amount accumulation-determining value in accordance with an atmospheric pressure correction factor and a fuel level correction factor, and whereby, when a purge amount accumulation value according to said evaporation purge system exceeds an abnormality diagnosis start purge amount accumulation-determining value after start-up of said engine, then control is executed to diagnose at least one of said internal tank pressure sensor and said atmosphere valve as abnormal when the internal tank pressure detected by said internal tank pressure sensor does not reach any value between minimum and maximum internal tank pressure values with reference to atmospheric pressure in a state where said purge valve is closed and said atmosphere valve is opened.

2. An abnormality-diagnosing device for an evaporation purge system of an internal combustion engine, said purge system including: an evaporation passage communicated to a fuel tank of said engine, a canister into which evaporative fuel is introduced from said fuel tank through said evaporation passage, a purge passage through which the evaporative fuel is purged from said canister into an intake passage of said engine, an ambient air passage through which said canister communicates to the atmosphere, an internal tank pressure sensor for detecting internal tank pressure of said fuel tank, a purge valve driven on the basis of a duty value for regulating a purge flow rate, and an atmosphere valve for opening and closing said canister to/from the atmosphere;

said abnormality-diagnosing device comprising: a control means whereby, when a purge amount accumulation value exceeds an abnormality diagnosis start purge amount accumulation-determining value after start-up of said engine, both of said internal tank pressure sensor and said atmosphere valve are diagnosed as normal when the internal tank pressure achieves any value between minimum and maximum internal tank pressure values with reference to atmospheric pressure in a state where said purge valve is closed and said atmosphere valve is opened, and wherein after the internal tank pressure detected by said internal tank pressure sensor achieves a target internal tank pressure through purging of the evaporative fuel by said atmosphere valve being closed and said purge valve being opened slowly, then control is executed so as to diagnose both said evaporation passage and said purge passage as normal when the internal tank pressure is less than the target pressure, even with lapse of a given time in a state where said purge valve and said atmosphere valve both are closed.

3. An abnormality-diagnosing device for an evaporation purge system according to claim 2, wherein while the evaporative fuel is purged by said atmosphere valve being closed and said purge valve being opened slowly according to the duty value, said control means practices control so as to retain the duty value of said purge valve at a given value when a fuel feedback correction amount achieves a correction limit value in air-fuel ratio control, and wherein said control means executes control so as to reopen said purge valve slowly according to the duty value when said fuel feedback correction amount is returned from said correction limit value toward a non-limit by a predetermined value.

4. An abnormality-diagnosing device for an evaporation purge system according to claim 2, wherein said control means monitors at least one of a throttle opening variation amount, an engine load variation amount of said engine, and a posture variation amount of a vehicle having said engine disposed therein during execution of an abnormality diagnosis, and wherein said control means provides control so as to stop the abnormality diagnosis when such a variation amount exceeds a diagnosis stop variation amount-determining value.

5. An abnormality-diagnosing device for an evaporation purge system according to claim 2, wherein said control means monitors an abnormality diagnosis time fuel feedback correction amount during execution of an abnormality diagnosis, the abnormality diagnosis time fuel feedback correction amount being added in air-fuel ratio control, and wherein said control means provides control so as to stop the abnormality diagnosis when the abnormality diagnosis time fuel feedback correction amount exceeds a diagnosis stop correction amount-determining value.

6. An abnormality-diagnosing device for an evaporation purge system according to claim 2, wherein said control means provides control so as to correct the given time according to an atmospheric pressure correction factor and a fuel level correction factor, in which given time a determination and a comparison are made between an internal tank pressure and a target internal tank pressure in a state where said purge valve and said atmosphere valve both are closed.

7. An air-fuel ratio controller for an internal combustion engine equipped with an abnormality-diagnosing device for an evaporation purge system, said abnormality-diagnosing device diagnosing said evaporation purge system to check for abnormalities;

said evaporation purge system including: an evaporation passage communicated to a fuel tank of said engine, a canister into which evaporative fuel is introduced from said fuel tank through said evaporation passage, a purge passage through which the evaporative fuel is purged from said canister into an intake passage of said engine, an ambient air passage through which said canister communicates to the atmosphere, an internal tank pressure sensor for detecting internal tank pressure of said fuel tank, a purge valve subjected to opening control on the basis of a duty value for regulating a purge amount, and an atmosphere valve for opening and closing said canister to/from the atmosphere;

said air-fuel ratio controller comprising: a control means whereby, during non-execution of the abnormal diagnosis by said abnormality-diagnosing device, a feedback control amount calculated from an output signal from an oxygen sensor, said oxygen sensor being disposed in an exhaust passage of said engine, is corrected according to a fuel feedback correction amount, thereby executing air-fuel ratio control so as to bring an air-fuel ratio to a target value, and further learning control is executed so as to learn the fuel feedback correction amount, and wherein during execution of the abnormality diagnosis by said abnormality-diagnosing device, control is performed in such a manner so as to stop the learning control of the fuel feedback correction amount, and further the air-fuel ratio control is effected in such a manner so as to bring the air-fuel ratio to the target value by an abnormality diagnosis time fuel feedback correction amount being added to the fuel feedback correction amount.

8. The air-fuel ratio controller for an internal combustion engine according to claim 7, wherein when said purge valve is opened during execution of the abnormality diagnosis by said abnormality-diagnosing device, then said control means provides correction control such that a proportional correction portion and an integral correction portion of the fuel feedback correction amount are made greater.

9. An abnormality-diagnosing method of an evaporation purge system of an internal combustion engine, comprising the steps of:

(1) determining if a purge amount accumulation value exceeds a start purge amount accumulation-determining value after starting the engine, (2) determining minimum and maximum tank pressure values based on atmospheric air pressure, (3) determining by an internal fuel tank pressure sensor if internal fuel tank pressure is between the minimum and maximum tank pressure values in a state where a purge valve is closed and an atmosphere valve is opened, and (4) diagnosing at least one of the internal fuel tank pressure sensor and the atmosphere valve as abnormal when the purge amount accumulation value exceeds the start purge amount accumulation-determining value and the internal fuel tank pressure is not between the minimum and maximum tank pressure values in the state where the purge valve is closed and the atmosphere valve is opened.

10. An abnormality-diagnosing method of an evaporation purge system of an internal combustion engine, comprising the steps of:

(1) determining if a purge amount accumulation value exceeds a start purge amount accumulation-determining value after starting the engine, (2) determining by an internal fuel tank pressure sensor if an internal fuel tank pressure is between minimum and maximum tank pressure values in a state where a purge valve is closed and an atmosphere valve is opened, (3) diagnosing the internal tank pressure sensor and atmosphere valve as normal when internal tank pressure is between the minimum and maximum tank pressure values in a state with the purge valve being closed and the atmosphere valve being opened, and (4) diagnosing at least one of the internal fuel tank pressure sensor and the atmosphere valve as abnormal when the purge amount accumulation value exceeds the start purge amount accumulation-determining value and the internal fuel tank pressure is not between the minimum and maximum tank pressure values in the state where the purge valve is closed and the atmosphere valve is opened.

11. The method according to claim 10, further comprising the step of diagnosing both the evaporation passage and purge passage as normal when internal tank pressure is less than a target pressure in a state with the atmosphere valve being closed and the purge valve being opened.

12. The method according to claim 11, further comprising the steps of:

stopping abnormality diagnosis when a variation in at least one of throttle opening, engine load, vehicle inclination, and vehicle roll exceeds a stop diagnosis value; and stopping abnormality diagnosis when monitored abnormality diagnosis time fuel feedback correction amount exceeds a diagnosis stop value.

* * * * *